US006869058B2

(12) United States Patent
Tung

(10) Patent No.: US 6,869,058 B2
(45) Date of Patent: Mar. 22, 2005

(54) BASE ASSEMBLY FOR A SUNSHADE

(76) Inventor: Benson Tung, No. 587, Chien-Gong Road, Kaohsiung (TW)

( * ) Notice: Subject to any disclaimer, the term of this patent is extended or adjusted under 35 U.S.C. 154(b) by 47 days.

(21) Appl. No.: 10/463,759

(22) Filed: Jun. 17, 2003

(65) Prior Publication Data

US 2005/0017148 A1 Jan. 27, 2005

(51) Int. Cl.[7] ..... F16M 13/00
(52) U.S. Cl. ..... 248/519; 248/529; 248/910
(58) Field of Search ..... 248/910, 519, 248/523, 529, 188.1; 135/16; 52/165, 719

(56) References Cited

U.S. PATENT DOCUMENTS 1,551,637 A * 9/1925 Bowlen ..... 431/292
1,735,671 A * 11/1929 Bunker ..... 232/43.2
1,788,030 A * 1/1931 Penn ..... 248/687
2,351,293 A * 6/1944 Saunders ..... 482/147
3,415,475 A * 12/1968 Goodman ..... 248/158
3,588,013 A * 6/1971 Mazak ..... 248/158
3,841,631 A * 10/1974 Dolan ..... 473/481
4,109,910 A * 8/1978 Gleason ..... 473/479
4,201,975 A * 5/1980 Marcus ..... 340/908
5,354,031 A * 10/1994 Bilotti ..... 248/519
5,460,353 A * 10/1995 Rittenhouse ..... 256/1
5,842,670 A * 12/1998 Nigoghosian ..... 248/160
6,047,939 A * 4/2000 Kim ..... 248/371
6,305,659 B1 * 10/2001 Metelski ..... 248/519
6,325,352 B1 * 12/2001 Story ..... 248/678
D485,055 S * 1/2004 Taylor ..... D3/10

* cited by examiner

*Primary Examiner*—Korie Chan
(74) *Attorney, Agent, or Firm*—Alan D. Kamrath; Nikolai & Mersereau, P.A.

(57) ABSTRACT

A base assembly for a sunshade includes a base having a recessed portion defined in an upper side thereof, allowing additional weight to be removably inserted into the recessed portion. The base further includes a tubular portion for receiving a lower end of a post of a sunshade. A spacer is preferably attached to an underside of the base for keeping the base at a level above ground. The tubular portion of the base may include a threaded section. A sleeve has a threaded section for threadedly engaging the threaded section of the tubular portion of the base, with the lower end of the post being received in the lower end of the sleeve.

14 Claims, 8 Drawing Sheets

BASE ASSEMBLY FOR A SUNSHADE

BACKGROUND OF THE INVENTION

1. Field of the Invention

The present invention relates to a base assembly for a sunshade. In particular, the present invention relates to a base assembly that can be used with sunshade posts of various diameters.

2. Description of the Related Art

FIG. 1 of the drawings illustrates a sunshade 1 with a conventional base 12. FIG. 2 is an enlarged sectional view of the base 12 in FIG. 1. The base 12 is attached to a lower end of a post 11 of the sunshade 1 for supporting the sunshade 1 in an upright position. The base 12 includes a main portion 121 that is a disc-like member made of cast iron and a sleeve 122 fixed on top of the main portion 121. The lower portion 123 of the post 11 is placed into the sleeve 122, and two screws 124 are extended through screw holes (not labeled) of the sleeve 122 to be in frictional contact with an outer periphery of the lower portion of the post 11. The sunshade 1 is thus kept in an upright position.

Spacers (not shown) are often attached to an underside of the main portion 121 for preventing the main portion 121 from rusting. However, the padding members are apt to be disengaged from the main portion 121 and thus lost. Further, when the canopy of the sunshade 1 is in an opened state, the sunshade 1 is apt to fall down when subject to strong winds. To avoid falling down of the sunshade 1, the weight of the base 12 must be increased, which increases the burden of moving the base 12. Attachment of an additional weight to the underside of the base 12 has been proposed, yet this involves placing the bulky base 12 down to a horizontal position before attachment of the additional weight and moving the base 12 (which is now heavier) back to the upright position, which is troublesome and laborious.

SUMMARY OF THE INVENTION

An object of the present invention is to provide a base assembly for a sunshade which allows easy attachment/removal of additional weight to/from the base.

Another object of the present invention is to provide a base assembly for a sunshade that does not rust easily.

A further object of the present invention is to provide a base assembly for a sunshade that allows use with sunshade posts of various diameters.

A base assembly for a sunshade in accordance with an embodiment of the invention includes a base and at least one weight. The base includes a recessed portion defined in an upper side thereof. The base further includes a tubular portion for receiving a lower end of a post of a sunshade. The weight is removably insertable into the recessed portion of the base.

In a preferred embodiment of the invention, the weight includes a central hole through which the tubular portion extends. The tubular portion has a non-circular extension, and the weight has a non-circular recess defined in an underside thereof for engaging with the non-circular extension of the tubular portion.

Preferably, a spacer is attached to an underside of the base for keeping the base at a level above ground. The spacer is preferably a ring with a plurality of protrusions formed on an underside thereof. Screws are extended through holes of the base into screw holes of the ring, respectively.

A cover may be mounted on top of the base and includes a central hole through which the tubular portion of the base extends.

In an embodiment of the invention, the tubular portion of the base includes a threaded section. A sleeve has a threaded section for threadedly engaging the threaded section of the tubular portion of the base, with the lower end of the post being received in the lower end of the sleeve.

In a further embodiment of the invention, the tubular portion has a screw hole, and a screw is extended through the screw hole of the tubular portion for frictional contact with an outer periphery of the lower portion of the post.

In another embodiment of the invention, the tubular portion of the base includes an inner threading section. An adaptor sleeve is mounted in the tubular portion of the base. The adaptor sleeve has an inner threading and an outer threading for engaging with the inner threading of the tubular portion of the base. A sleeve is mounted in the adaptor sleeve and has an outer threading for threadedly engaging with the inner threading of the adaptor sleeve, with the lower end of the post being received in the lower end of the sleeve.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
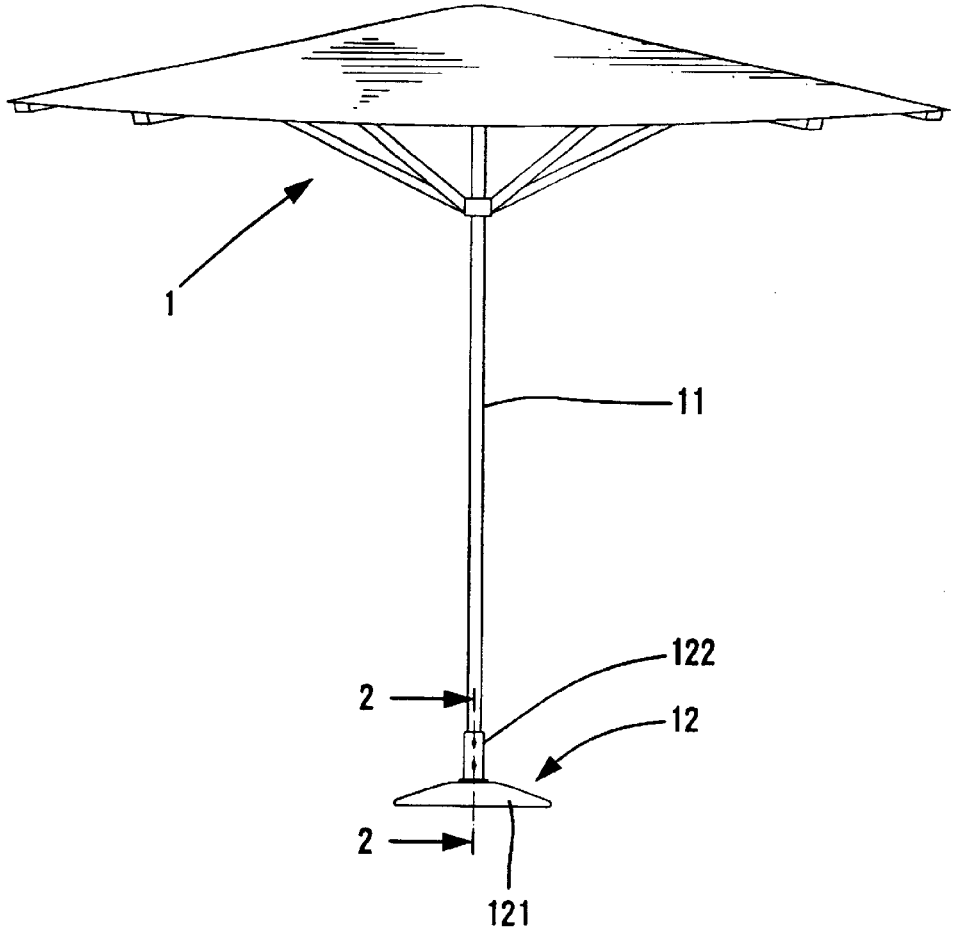
FIG. 1 PRIOR ART
FIG. 1 is a schematic side view of a sunshade with a conventional base.
Figure 2:
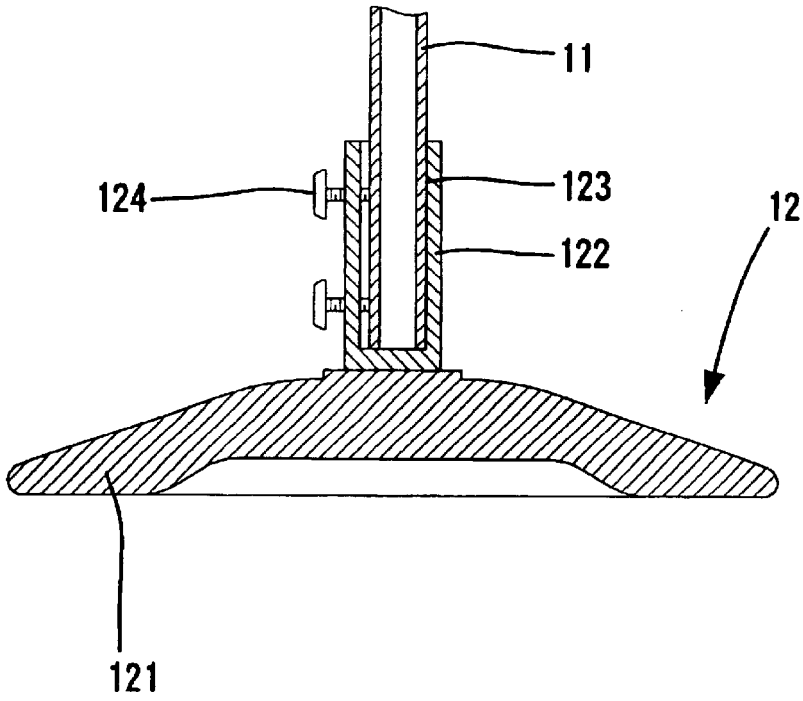
FIG. 2 PRIOR ART
FIG. 2 is a sectional view taken along line 2—2 in FIG. 1.
Figure 3:
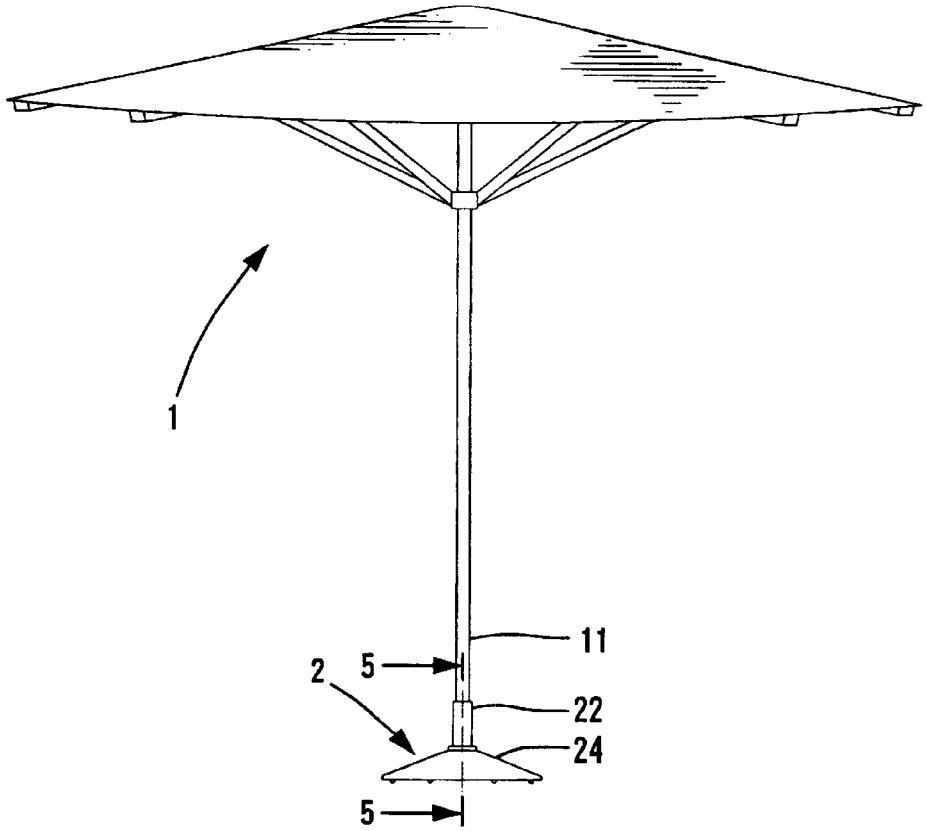
FIG. 3 is a schematic side view of a sunshade with a base assembly in accordance with the present invention.
Figure 4:
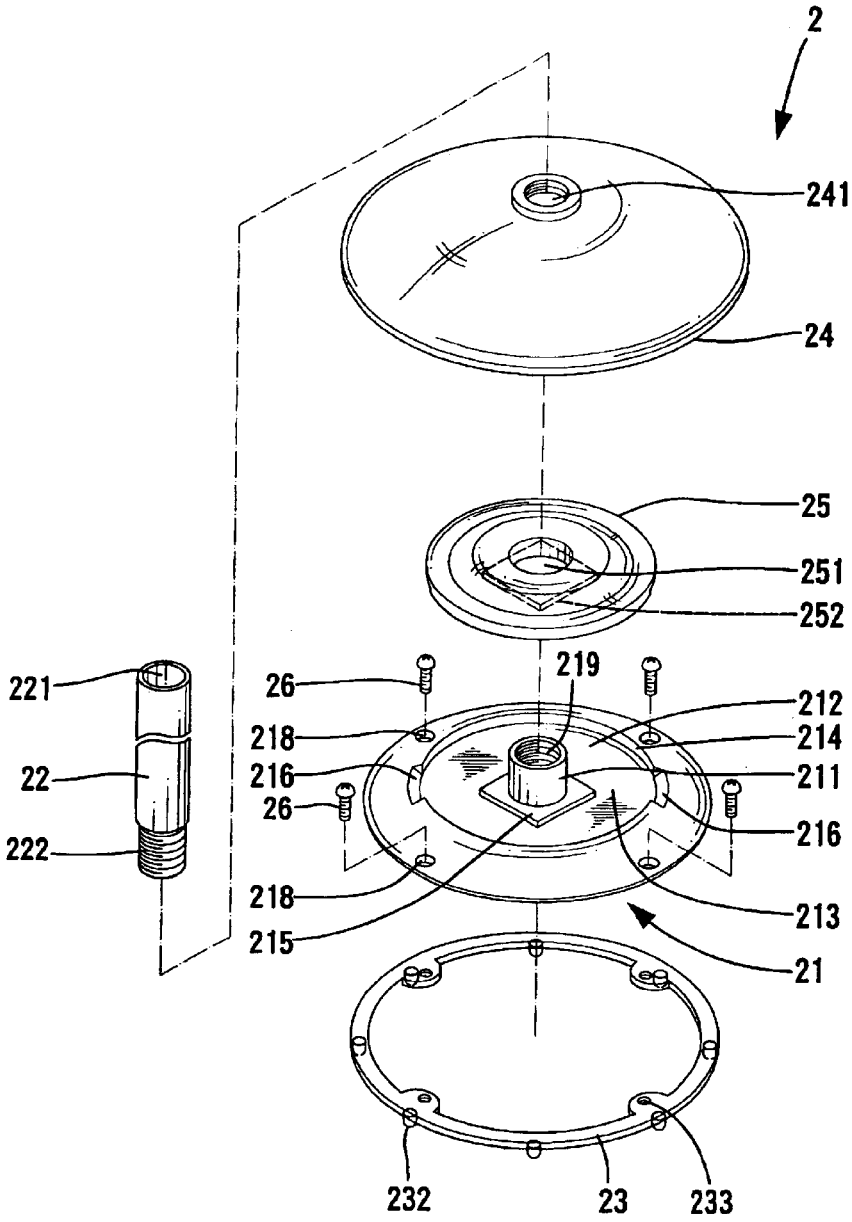
FIG. 4 is an exploded perspective view of the base assembly in accordance with the present invention.
Figure 5:
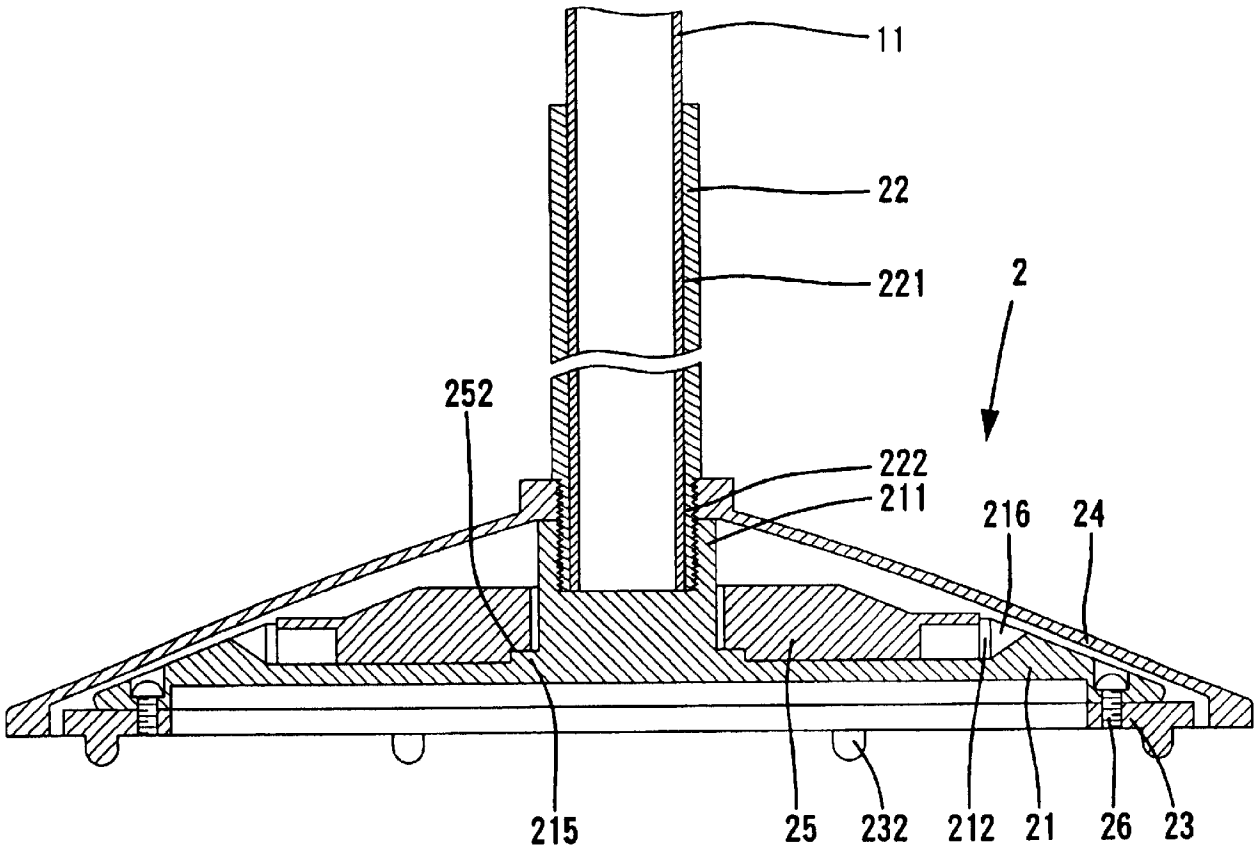
FIG. 5 is a sectional view taken along line 5—5 in FIG. 3.

Referring to FIGS. 3 through 5, a base assembly in accordance with the present invention is designated by "2" and attached to a lower end of a post 11 of a sunshade 1. The base assembly 2 includes a base 21, a sleeve 22, and at least one weight 25. The base 21 is made of cast iron to provide a stable support for the post 11 of the sunshade 1 and includes a recessed portion 212 in an upper side thereof. The recessed portion 212 is preferably annular and concentric with the base 21. A tubular member 211 is provided on a central portion of the upper side of the base 21. The weight 25 is removably placed into the recessed portion 212. In this embodiment, the weight 25 is a disc-like member having a central hole 251 through which the tubular member 211 extends; namely, the weight 25 is mounted around the tubular member 211. Preferably, the weight 25 includes a non-circular recess 252 in an underside thereof, and a non-circular extension 215 is formed on an outer periphery of the tubular member 211 or a bottom wall 213 delimiting the recessed portion 212, thereby securely positioning the weight 25. Preferably, a peripheral wall 214 delimiting the recessed portion 212 includes two notches 216 to allow easy removal of the weight 25.

The sleeve 22 has a lower end having an outer threading 222 for threadedly engaging with an inner threading 219 of the tubular member 211, and the lower end of the post 11 of the sunshade 1 is inserted into a longitudinal hole 221 of the sleeve 22. Preferably, the sleeve 22 has an inner diameter sized to fittingly receive an outer diameter of the lower end of the post 11 of the sunshade 1, best shown in FIG. 5. A cover 24 is mounted on top of the base 21 and has a screw hole 241 threadedly engaged with the outer threading 222 of the sleeve 22. The user may remove the cover 24 and then place the weight 25 into the recessed portion 212 before attachment of the post 11. The weight 25 may be a block with or without hole, with the tubular member 211 extending or not extending through the hole of the block. Of course, the user may add as many weights as possible into the recessed portion 212 of the base 21 to provide a stable support for the post 11.

A spacer 23 is mounted to an underside of the base 21 to keep the base 21 at a level above the ground, thereby preventing the base 21 from rusting. The spacer 23 is made of plastic or rust-resisting material. In this embodiment, the spacer 23 is a ring, and a plurality of screws 26 are extended through holes 218 in the base 21 into screw holes 233 of the spacer 23. Further, a plurality of protrusions 232 are formed on an underside of the spacer 23 to keep the base 21 at a level above the ground, best shown in FIG. 5.

Figure 6:
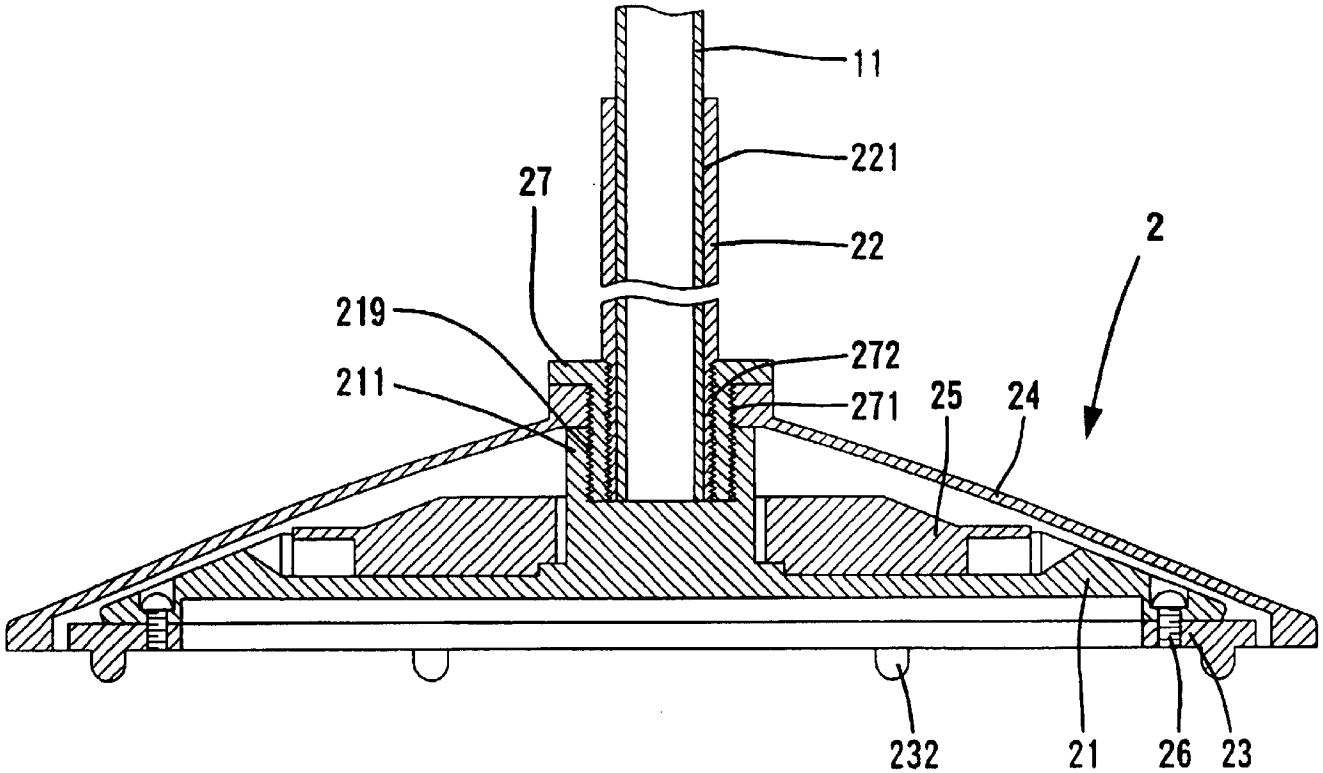
FIG. 6 is a sectional view similar to FIG. 5, illustrating a modified embodiment of the base assembly in accordance with the present invention.

FIG. 6 illustrates a modified embodiment of the invention, wherein the sleeve 22 in FIG. 6 has a diameter smaller than that of FIG. 5 for receiving a post 11 having a smaller diameter. An adaptor sleeve 27 is mounted between the tubular member 211 of the base 21 and the sleeve 22. The adaptor sleeve 27 has an outer threading 271 for threadedly engaging with the inner threading 219 of the tubular member 211 and an inner threading 272 for threadedly engaging with the outer threading 222 of the sleeve 22. Thus, the base assembly 2 in accordance with the present invention can be used with sunshade posts of various sizes.

Figure 7:
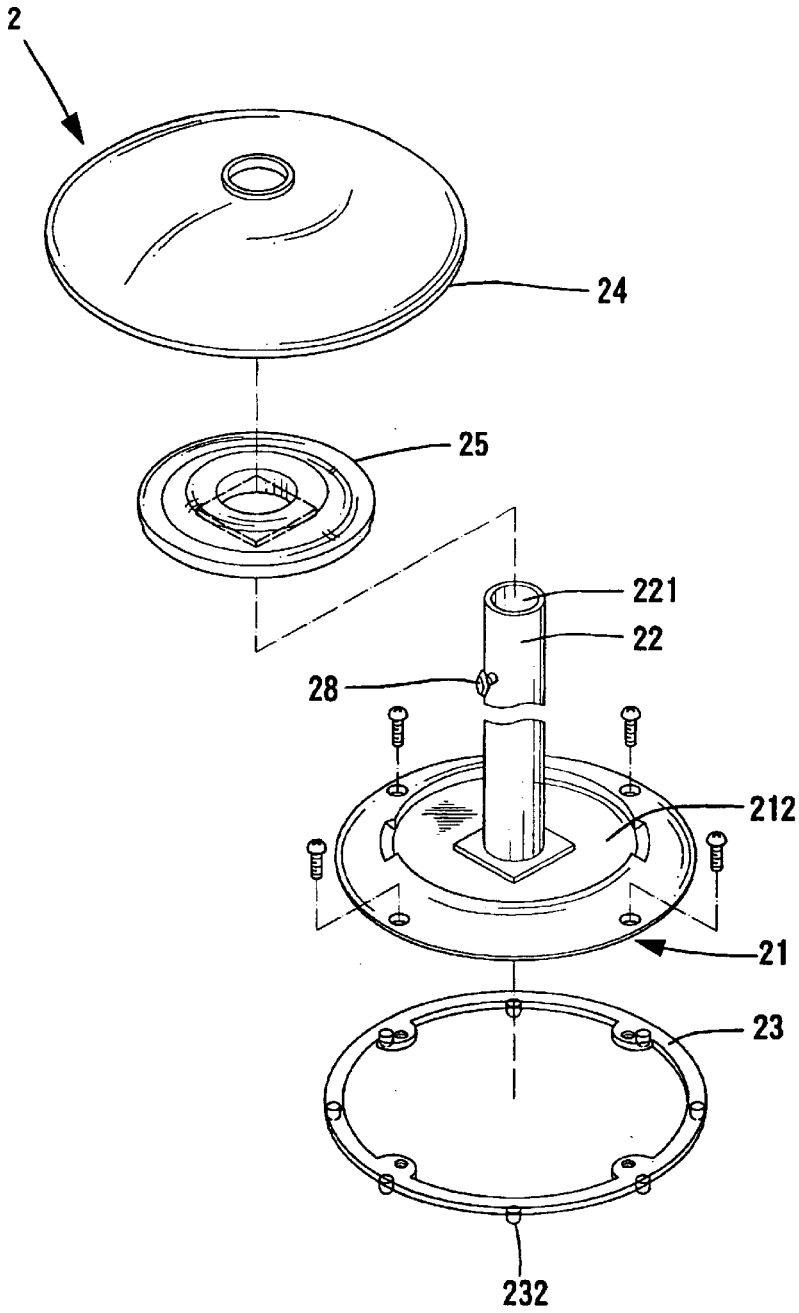
FIG. 7 is an exploded perspective view of another modified embodiment of the base assembly in accordance with the present invention.
Figure 8:
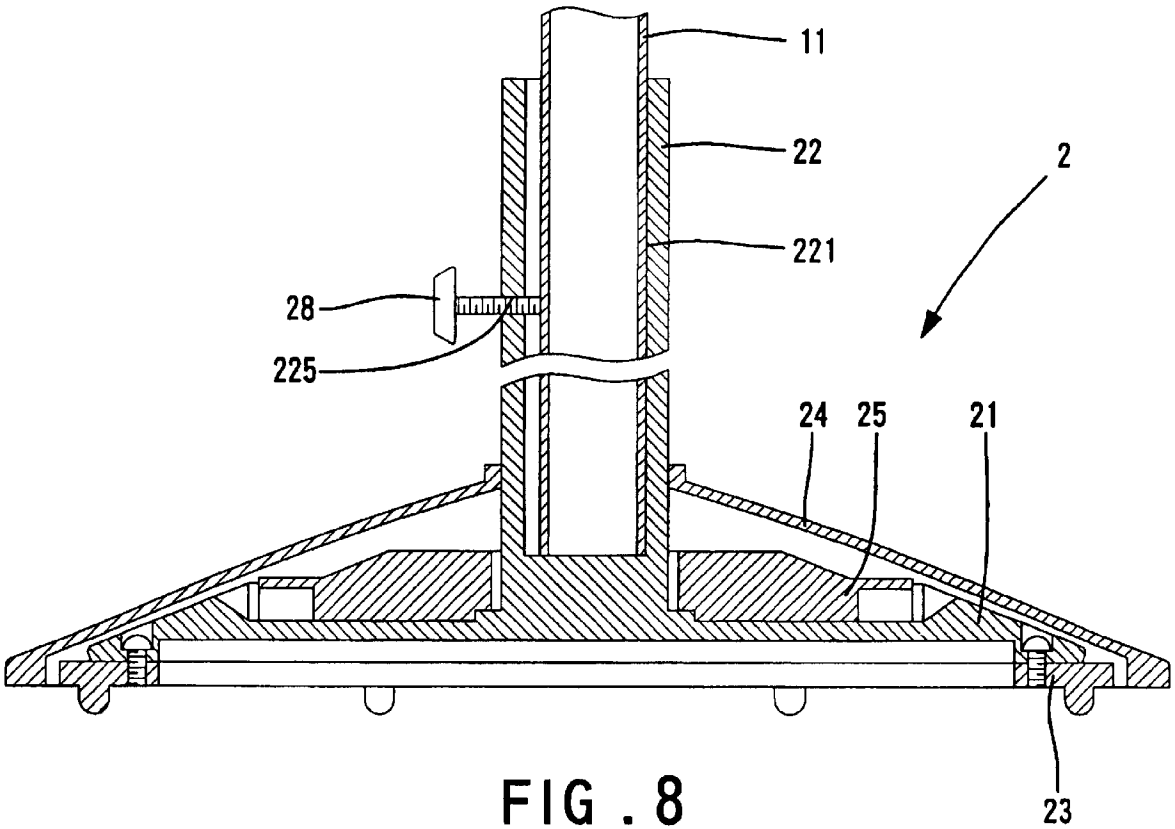
FIG. 8 is an enlarged sectional view of a lower portion of a sunshade and the base assembly of FIG. 7.

FIGS. 7 and 8 illustrate a modified embodiment of the invention, wherein the sleeve 22 has no outer threading and the tubular member 211 has no inner threading. Further, the sleeve 22 and the tubular member 211 are integrally formed as a single tubular member or sleeve 22 for receiving a lower end of a post 11 of a sunshade 1. A screw or bolt 28 is extended through a screw hole 225 of the sleeve 22 to be in frictional contact with an outer periphery of the lower end of the post 11, thereby keeping the post 11 in an upright position.

Although the invention has been explained in relation to its preferred embodiment, it is to be understood that many other possible modifications and variations can be made without departing from the scope of the invention as hereinafter claimed.

What is claimed is:

1. A base assembly for a sunshade comprising:

a base including a recessed portion defined in an upper side thereof, the base filter including a tubular portion adapted to receive a lower end of a post of a sunshade, the tubular portion having a non-circular extension; and at least one weight removably insertable into the recessed portion of the base, said at least one weight including a central hole through which the tubular portion extends, said at least one weight having a non-circular recess defined in an underside thereof for engaging with the non-circular extension of the tubular portion.

2. The base assembly for a sunshade as claimed in claim 1, further including a spacer attached to an underside of the base for keeping the base at a level above ground.

3. The base assembly for a sunshade as claimed in claim 2, wherein the spacer is a ring with a plurality of protrusions formed on an underside thereof, the base having a plurality of holes, the ring having a plurality of screw holes, with a plurality of screws extending through the holes of the base into the screw holes of the ring, respectively.

4. The base assembly for a sunshade as claimed in claim 1, further including a cover mounted on top of the base, the cover including a central hole through which the tubular portion of the base extends.

5. The base assembly for a sunshade as claimed in claim 1, wherein the tubular portion has a screw hole, with the base assembly further including a screw extending through the screw hole of the tubular portion for frictional contact with an outer periphery of the lower portion of the post.

6. The base assembly for a sunshade as claimed in claim 1, wherein the tubular portion of the base includes a threaded section, with the base assembly further including a sleeve having a threaded section for threadedly engaging the threaded section of the tubular portion of the base, with the lower end of the sleeve being adapted to receive the lower end of the post.

7. The base assembly for a sunshade as claimed in claim 6, further including a spacer attached to an underside of the base for keeping the base at a level above ground.

8. The base assembly for a sunshade as claimed in claim 6, further including a cover mounted on top of the base, the cover including a central hole through which the tubular portion of the base extends.

9. The base assembly for a sunshade as claimed in claim 6, wherein the sleeve has an inner diameter the same as an outer diameter of the lower portion of the post.

10. The base assembly for a sunshade as claimed in claim 1, wherein the tubular portion of the base includes an inner threading threaded section, with the base assembly further including an adaptor sleeve mounted in the tubular portion of the base, the adaptor sleeve having an inner threading and an outer threading for engaging with the inner threading of the tubular portion of the base, a sleeve being mounted in the adaptor sleeve and having an outer threading for threadedly engaging with the inner threading of the adaptor sleeve, with the lower end of the post being received in the lower end of the sleeve.

11. The base assembly for a sunshade as claimed in claim 10, further including a spacer attached to an underside of the base for keeping the base at a level above ground.

12. The base assembly for a sunshade as claimed in claim 10, further including a cover mounted on top of the base, the cover including a central hole through which the tubular portion of the base extends.

13. The base assembly for a sunshade as claimed in claim 10, wherein the tubular portion has a screw hole, with the base assembly further including a screw extending through the screw hole of the tubular portion for frictional contact with an outer periphery of the lower portion of the post.

14. The base assembly for a sunshade as claimed in claim 10, wherein the sleeve has an inner diameter the same as an outer diameter of the lower portion of the post.

* * * * *